US010737838B2

(12) United States Patent
Mayer et al.

(10) Patent No.: US 10,737,838 B2
(45) Date of Patent: Aug. 11, 2020

(54) SYSTEM PACKING FOR THE SPACED PACKING OF ELONGATED OBJECTS AND CORRESPONDING PACKING METHOD

(71) Applicants: Markus Mayer, Lindau (DE); Stefan Brauchle, Wangen (DE); Thiemo Roesler, Wangen (DE)

(72) Inventors: Markus Mayer, Lindau (DE); Stefan Brauchle, Wangen (DE); Thiemo Roesler, Wangen (DE)

(73) Assignee: Rose Plastic AG

( * ) Notice: Subject to any disclaimer, the term of this patent is extended or adjusted under 35 U.S.C. 154(b) by 647 days.

(21) Appl. No.: 15/133,714

(22) Filed: Apr. 20, 2016

(65) Prior Publication Data

US 2016/0311606 A1 Oct. 27, 2016

(51) Int. Cl.

| | |
|---|---|
| ***B65D 85/20*** | (2006.01) |
| ***B65D 25/10*** | (2006.01) |
| ***B65B 61/20*** | (2006.01) |
| ***B65B 39/00*** | (2006.01) |
| ***B65B 55/00*** | (2006.01) |
| ***B65B 5/06*** | (2006.01) |
| ***B65D 6/00*** | (2006.01) |
| ***B65B 19/00*** | (2006.01) |
| ***B65D 85/24*** | (2006.01) |
| *B65B 7/28* | (2006.01) |

(52) U.S. Cl.

CPC ..... *B65D 25/108* (2013.01); *B65B 5/068* (2013.01); *B65B 19/00* (2013.01); *B65B 39/007* (2013.01); *B65B 55/00* (2013.01); *B65B 61/207* (2013.01); *B65D 11/10* (2013.01); *B65D 85/24* (2013.01); *B65B 7/28* (2013.01)

(58) Field of Classification Search

CPC ..... B65D 25/108; B65D 11/10; B65D 85/24; B65B 5/068

USPC ..... 206/443

See application file for complete search history.

(56) References Cited

U.S. PATENT DOCUMENTS 2,392,675 A * 1/1946 Lamb ..... B65D 25/108 206/3
2,672,980 A * 3/1954 Halbach ..... B65D 25/108 206/427

(Continued)

FOREIGN PATENT DOCUMENTS

CN 202208466 U 5/2012
DE 7813627 UA 9/1978

(Continued)

*Primary Examiner* — King M Chu

(74) *Attorney, Agent, or Firm* — Dentons Cohen & Grigsby P.C.

(57) ABSTRACT

Packing for the spaced packing of elongated bar-like or rod-like articles, in particular of rods (16) that are stored in a packing sleeve (1) that is open on at least one end while maintaining a mutual radial separation between them, wherein on the opening (5) of the packing sleeve (1) a multi-part lattice support (10) consisting of at least one lattice-like top part (7) and at least one lattice-like bottom part (8) that is detachably connected with it can be placed, that the rods (16) with their base-side ends extend through the aligned lattice openings (14*a*, 14*b*) of the top and bottom part (7, 8) and the at least one bottom part (8) is detachably connected with the top part (7) and can slide in the interior of the packing sleeve.

21 Claims, 3 Drawing Sheets

(56) References Cited

U.S. PATENT DOCUMENTS 3,184,071 A * 5/1965 Delaire ..... B65D 11/22 211/74
3,980,115 A * 9/1976 Longo ..... A63B 55/00 206/315.6
4,332,283 A * 6/1982 Rader ..... A63B 55/00 206/315.6
4,947,998 A * 8/1990 Smeller ..... A47G 25/12 206/373
5,271,520 A * 12/1993 McAfee ..... A01K 97/06 206/315.11
5,337,894 A * 8/1994 Ivey ..... B01L 9/06 206/370
5,447,228 A * 9/1995 Hodgson, III ..... A63B 55/00 206/315.3
5,465,840 A * 11/1995 Joh ..... A63B 55/00 206/315.6
5,573,115 A * 11/1996 Fuller ..... A47F 7/0028 206/362
5,628,400 A * 5/1997 Feder ..... B25H 3/003 206/372
5,850,922 A * 12/1998 Fraser ..... B65D 5/5035 206/349
6,679,377 B2 * 1/2004 Maddox ..... A01K 97/06 206/315.11
6,774,792 B1 * 8/2004 Williams ..... A63B 55/00 206/315.3
6,814,233 B2 * 11/2004 Hammen ..... F41B 5/06 124/86
6,883,268 B2 * 4/2005 Fraser ..... A01K 97/22 206/315.11
7,665,612 B2 * 2/2010 Turner ..... B65D 5/5069 206/410
7,676,983 B2 * 3/2010 Jenkins ..... A01K 97/06 248/512
8,100,265 B2 * 1/2012 Farley ..... B65D 85/66 206/326
2003/0047474 A1 * 3/2003 Dahlson ..... B65D 5/4204 206/423
2003/0116463 A1 6/2003 Langtry
2007/0286775 A1 * 12/2007 Yong ..... B01L 3/0293 422/400
2011/0296800 A1 * 12/2011 Clark ..... B65D 5/503 53/443

FOREIGN PATENT DOCUMENTS

DE 202414445 U 9/2012
WO 2003062096 A1 7/2003

* cited by examiner

SYSTEM PACKING FOR THE SPACED PACKING OF ELONGATED OBJECTS AND CORRESPONDING PACKING METHOD

BACKGROUND OF THE INVENTION

Field of the Invention

This invention relates to a system for the spaced packing of elongated objects and a corresponding method for the packing of elongated objects in a system of this type.

Discussion of the Prior Art

Elongated objects, e.g. bars, flat shapes, round shapes etc. are characterized by the fact that the diameter of the elongated object is significantly less than its length. For the packing of multiple elongated objects of this type, in the prior art the objects are separated from one another with spaces by the presence of continuous partitions in the interior of a packing sleeve that surrounds the object all around its outside periphery and are vertically continuous, so that when an elongated object of this type is inserted an insertion channel is formed that holds the elongated object and leads to the bottom of the packing.

System packings of this type are used successfully in a wide range of applications, although they have the disadvantage that they are difficult to produce and consume a great deal of material. Specifically, the insertion channels that extend from the upper side of the packing to the bottom must be manufactured individually, and with plastic packing it is difficult and expensive to produce continuous insertion channels of this type that make possible a reliable separation of the individual objects inserted into the packing.

For packing in cardboard boxes, for example, the prior art includes the use of two-piece separator arrangements that are also called lattice supports. The manufacture of cardboard packing of this type is simple, because different folding cut-out blanks are assembled. It is known that one lattice support can be placed into the packing on the bottom side and another lattice support can be placed on the top side, wherein the two lattice supports are in contact with each other as much as possible over their longitudinal extensions to make possible a continuous insertion opening in the area of an insertion channel.

Packing of this type can therefore be produced economically and efficiently only in the form of cardboard packages because the assembly of a plurality of cardboard cutouts and their gluing together can be automated. However, when the task at hand is the packing of high-value objects that may also weigh a considerable amount, only plastic packing or sheet metal packaging can be considered.

Plastic-coated cardboard packaging can also be considered.

One disadvantage with all these types of packaging, however, is that with heavy objects, secure packing is not possible. For example, metal bars or similar high-value objects cannot be packed in a spaced system packing of this type so that they do not touch one another. Especially when the objects to be packed are relatively long, such as objects in the length range between 10 cm and 100 cm, cardboard packages of this type can no longer be used. On account of the weight of these objects, there is a danger that the rod-shaped object will puncture the bottom or top of the cardboard package.

In particular, it is a question of packing elongated objects of this type with a diameter-to-length ratio in the range of 30 D, which is not possible with conventional packing.

The prior art does not describe a plastic package that would make it possible to realize continuous insertion channels.

SUMMARY OF THE INVENTION

Therefore the object of the invention is to develop a system for the spaced packing of a plurality of elongated objects so that the elongated objects can be packed in a spaced manner, preventing contact between them, in a packing sleeve made of plastic.

The object of the system is to make possible a secure and reliable spacing between the elongated objects and thereby to maintain small distances between the objects without the objects touching one another. It therefore becomes possible to pack a plurality of elongated objects in a narrow space with a high packing density while maintaining a distance between them without running the risk that the rod-like objects will come into contact with or even puncture the package in the event of an impact or movement of the packing.

In particular, this invention provides—although only as one preferred exemplary embodiment—a very small package for the packing of 25 metal bars or rods, wherein the package may have a total outside diameter of only 55×55 mm, and the elongated objects have a diameter, for example, of 6 mm and a distance between one another in the range of approximately 2 to 3 mm. The result is a plastic package with high packing density.

In spite of this small distance it is possible to successfully protect the rods and prevent them from coming into contact with one another as a result of the features according to the invention.

One feature of the invention is that on the opening of the packing sleeve, a multi-part top part consisting of at least one lattice-like top part and at least one bottom part consisting of a lattice support that can be detachably connected with the top part can be placed, that the rods extend with their bottom-side ends through the lattice openings of the top and bottom parts that are flush with one another, and that the at least one bottom part is detachably connected with the top part and is designed so that it can slide in the interior of the packing sleeve.

The resulting advantage is that with the bottom part sitting on the base surface of the packing sleeve and its bottom surface, on which the bottom-side ends of the rods sit, protection against puncturing of the packing is simultaneously achieved without the need for additional complex, expensive and separate bottom-side protective cushions.

The focus of this invention is therefore a system that consists of a packing sleeve that is open on one end, at which a multi-layer lattice support is placed.

According to the invention, the multi-layered lattice support is at least a two-part piece and consists of a top part and a bottom part which is detachably connected with the top part. The top part is designed and constructed so that it sits on the opening of the packing sleeve, and the bottom part which is detachably connected with the top part is designed and constructed so that it can be detached and separated from the top part.

For example, it is preferable if during the packing of the elongated objects, the bottom part can be detached from the top part by finger pressure and, together with the objects to be packed, which are loaded with the end side on the bottom part, can be pushed in a sliding manner into the interior of the packing sleeve until they rest on the bottom surface on the inside of the packing sleeve.

Therefore a completely new system for the spaced packing of elongated objects is created, because it is now possible for the first time, without the need for continuous, elongated insertion channels, to achieve the spaced packing of elongated objects even in an extremely narrow space without the need to create insertion channels that extend over the entire length of the plastic packing.

The core teaching of the invention is that a lattice support is designed and constructed in at least two parts and the following steps are used for the execution of the packing method:

1. In a first method step, the lattice carrier that is composed of multiple layers is placed over the opening of the packing sleeve. In one preferred embodiment, the lattice carrier can be designed and constructed so that it can be locked with its top part on the opening of the packing sleeve.

2. In a second step of the method, the elongated objects are placed on the lattice carrier and are inserted with their lower ends into the lattice openings, so that their bottom sides extend through the lattice openings of the top part and are engaged in the lattice openings of the bottom part, and sit on the bottom wall located there, which forms the boundary of the lattice openings on the bottom side of the bottom part.

3. In the next step of the method, the detachable connection between the top part in the bottom part is separated by finger pressure, and in this step of the method the elongated objects drop downward as a result of their own weight or by the application of manual force, as a result of which, either by the dead weight of the elongated objects or by manual pressure on the elongated objects, the bottom part is separated from the top part and is displaced into the interior of the packing, and specifically until the bottom part sits on the base surface in the interior of the packing sleeve.

Therefore the insertion channels that create the spaces consist only of an upper part configured on the upper opening of the packing sleeve with corresponding lattice openings and an additional part located in the base area of the packing sleeve, which is designed and constructed in the for in of a bottom part with identical lattice openings.

The lattice openings of the top and bottom parts are aligned with one another and therefore continuous insertion channels are no longer formed, but only insertion channels that are present in the lattice-like top part that remains on the upper side of the packing sleeve, and additional insertion channels or lattice openings that are present in the bottom part, which when the packing is in its final state, sit on the base surface of the packing sleeve and are locked in place there.

Therefore one advantage of the invention is that it conserves material, because it is no longer necessary to use continuous insertion channels, because according to the invention only a lattice-like top part on the top side of the packing and a lattice-like bottom part that sits on the base side of the packing sleeve remain. The centering of the bars or rods to be packed is maintained during the packing process between the lattice-like top and the lattice-like bottom parts without the need for continuous insertion channels.

The mutual arrangement and orientation of the lattice openings between these two parts (top part and bottom part) therefore remains unchanged during the packing of the elongated objects. The elongated objects therefore ensure an automatic centering on the top and bottom part because during the packing process they press the bottom part toward the base surface of the packing sleeve and ultimately are immobilized there in the packed state.

In this manner it is possible for the first time, while saving plastic material and expensive production costs, to create a lattice-like internal distribution of a packing sleeve that is located only on the top side of the packing and on the inside base surface of the packing.

This invention preferably relates to a two-part lattice support that consists of the lattice-like top part and the lattice-like bottom part that is detachably connected with it.

The closure (detachable connection) between the top and bottom parts, which can preferably be opened and released by manual pressure, preferably consists of a snap connection. However, the invention is not limited to this embodiment. A connection of this type could also consist of a frictional connection or of other mechanically detachable connections such as, for example, a wedge-action connector or similar type of connection.

Likewise, the invention teaches that the detachable connection between the top part and the bottom part consists of a breakaway connector, so that by applying a certain force the connector webs between the top part and the bottom part are separated when the packing process begins.

Although it was indicated above that the lattice support are preferably designed and constructed in two parts, it should be noted that the invention is not restricted to lattice carriers consisting of this number of parts.

In another configuration, a lattice support that consists of more than two parts can also be present, in which case the method described above for the packing of elongated objects of this type then proceeds in a plurality of steps.

This configuration has the advantage that with particularly elongated objects that are more than 50 cm long, for example, additional spacing lattice elements can be located in the in-between space in the packing sleeve.

In an additional configuration of the invention, the above-mentioned multi-part lattice support can be inserted into a relatively short packing sleeve, and the packing method proceeds in the same manner, although the packing sleeve can be covered or closed by a relatively long protective sleeve. In this case, lattice-like spacing elements can also be located on the inside of the protective sleeve to hold the head area of the elongated objects.

It is also unimportant how the packing sleeve, which is open on one end, is closed from the top side. The closure can be a simple protective cap that is screwed or snapped or pushed onto the packing sleeve. A screw-cap packing can also be provided.

Instead of a simple protective cap that is used to close the packing sleeve, a second, additional, elongated packing sleeve can also be used which is also either screwed, inserted or snapped on.

The subject matter of the present invention is derived not only from the subject matter of the individual patent claims but also from the combination of the individual patent claims with one another.

All the information and features disclosed in the documents, including the abstract, and in particular the three-dimensional embodiment depicted in the drawings, are hereby claimed as essential to the invention inasmuch as they are novel individually or in any combination in comparison with the prior art.

Inasmuch as individual subject matters are referred to as "essential to the invention" or "important," this does not mean that these subject matters necessarily must form the subject matter of an independent claim. This is determined only by the respective valid version of the independent patent claim.

The invention is explained in greater detail below on the basis of several drawings which illustrate several means of embodiment. Additional features that are essential to the invention and advantages of the invention can be derived from these drawings and the description thereof.

DESCRIPTION OF A PRESENTLY PREFERRED EMBODIMENT

Figures 1, 2, 3, 4, 5, 6, 7, 8:
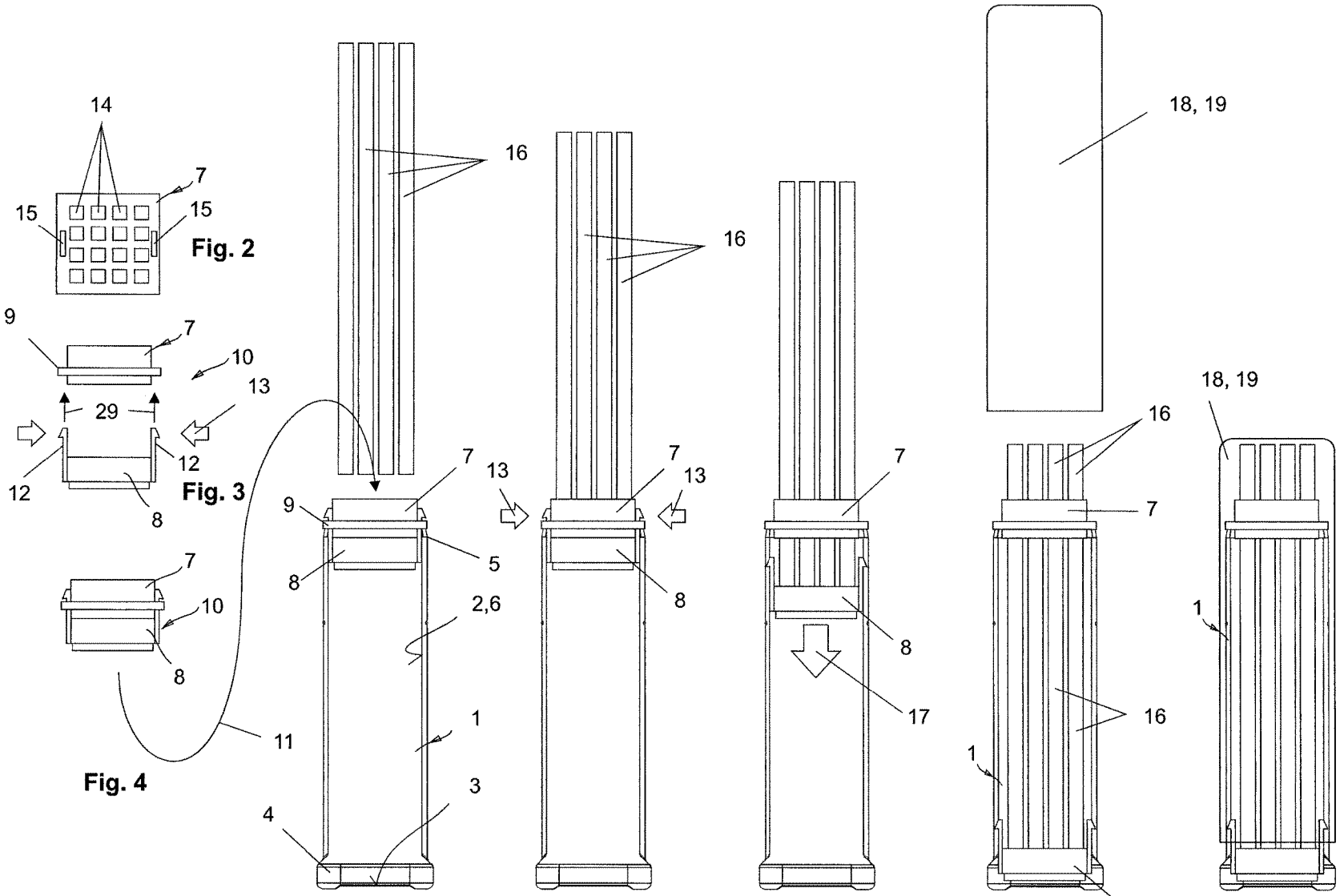
FIG. 1 illustrates a first step in the method of the packing of elongated objects, in particular bars, according to the present invention.
FIG. 2 illustrates a plan view from overhead of the lattice-like top part of the lattice support.
FIG. 3 illustrates an assembly drawing of the lattice support consisting of a top part and a bottom part.
FIG. 4 illustrates the assembled lattice support.
FIG. 5 illustrates an additional step in the method of the packing the bars illustrated in FIG. 1.
FIG. 6 illustrates further progress in the packing method.
FIG. 7 illustrates the final stage of the packing method.
FIG. 8 illustrates the finished package, including the installation of a protective sleeve, according to the present invention.

A packing sleeve 1 illustrated in FIG. 1 preferably consists of a plastic sleeve that is open on one end and essentially forms an interior space 2, the bottom side of which is closed by a base surface 3, wherein a stabilizing foot 4 can be located in the vicinity of the base surface 3. However it is not necessary to locate a stabilizing foot on the base surface 3.

The base surface 3 can also be eliminated and the packing sleeve 1 can be open on the base side. The invention is accordingly not limited to a closed base surface 3.

According to the invention, the system packing now consists of the spaced packing of elongated, bar-shaped or rod-shaped objects in the illustrated exemplary embodiment of the packing of bars 16 which, as illustrated in the first step of the method illustrated in FIG. 1, are placed from above on a lattice support that sits on the opening 5 of the packing sleeve 1.

As illustrated in FIGS. 2 to 4, the lattice support 10 is designed and constructed in at least two parts and consists of a lattice-like top part 7 and a lattice-like bottom part 8 designed with the same grid pattern and dimensions, wherein the grid pattern and dimensions of the lattices of the top and bottom parts are aligned with each other.

Likewise, FIG. 3 shows that the top part 7 is placed in a locking manner on the bottom part 8, wherein on the bottom part 8 there are two opposite locking tabs 12 that are engaged in corresponding locking slots 15 located in the top part 7.

The locking connection illustrated here between a locking mounting between the bottom part 8 and the top part 7 is shown exclusively by way of example. All detachable connections that can preferably be released by manual force applied in the direction of the arrows 13 are claimed.

Instead of manual force, a mechanical actuation in the direction of the arrow 13 can also be applied to unlock the snap connection between the top part 7 and the bottom part 8 connected with it in a locking manner.

The two parts can be plugged into each other in the direction indicated by the arrow 29 and thus form an at least two-part plug-and-socket part which is called the lattice support 10. The lattice support assembled in this manner as illustrated in FIG. 4 is accordingly placed on the opening 5 of the packing sleeve 1, and the bars or rods 16 to be packed are inserted with the bottom sides into the aligned lattice openings of the top part and bottom part, and are therefore supported with their base-side ends on the base wall 28 of the bottom part 8 (see FIG. 9).

FIG. 5 shows that when all the rods 16 run through the aligned lattice openings 14*a*, 14*b* of the top and bottom parts, the base sides of the bars 16 sit on the base wall 28 of the bottom part 8.

As illustrated in FIG. 6, manual or mechanical pressure is applied in the direction indicated by the arrow 13 to the locking connection between the top and bottom parts 7, 8, and on account of the dead weight of the bars 16, they displace, in the direction indicated by the arrow 17, the bottom part 8 into the interior 2 of the packing sleeve 1 in the axial direction.

It is preferable if the outside periphery of the bottom part 8 occupies the interior 2 of the packing sleeve in a more or less form-fitting manner while reserving some clearance for movement 1, to thereby prevent a tipping or rotation in the position illustrated in FIG. 6 during sliding in the packing sleeve.

Figure 10:
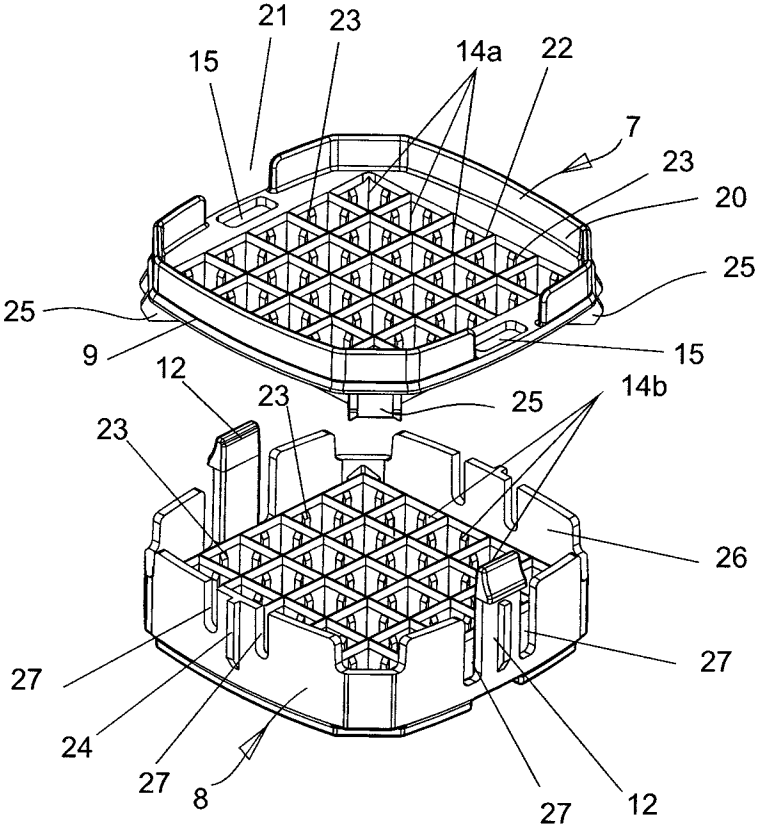
FIG. 10 illustrates an exploded view of the lattice support in a perspective view.
Figure 9:
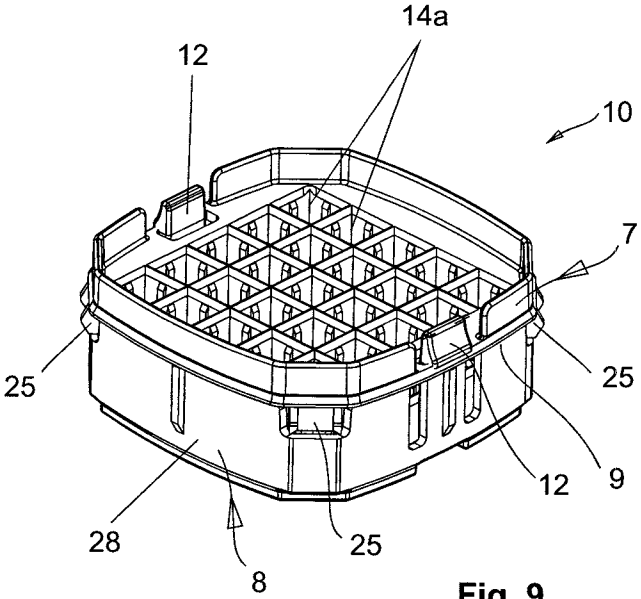
FIG. 9 illustrates a view in perspective of the lattice support in the assembled state.

Also, as illustrated in FIGS. 9 and 10, there are friction-increasing external nubs 24 on at least two facing sides of the surrounding guide wall 26 on the bottom part 8, wherein these external nubs 24, with the application of a friction closure, are in contact and centered against the inside wall of the interior 2 so that a centered lowering of the bottom part 8 occurs under sliding friction into the interior 2 of the packing sleeve 1 as illustrated in FIGS. 6 and 7.

Of course it is possible to improve or to make possible the axially directed displacement of the bottom part 8 into the interior of the packing sleeve 1 by manual or mechanical force applied to the upper side of the bars 16.

It has already been noted in the general descriptive portion that is not absolutely necessary to have a locking or snap connection between the top part 7 and the bottom part 8, because the connection can also be made by means of breakaway webs or similar connectors, so that by the application of a corresponding axial force on the bars 16, the connection between the top part 7 and bottom part 8 can be released and the webs broken off, so that the bottom part 8 is displaced into the interior 2 of the packing sleeve 1 as illustrated in FIG. 6.

So that the top part 7 is not displaced with the bottom part 8 into the interior 2 of the packing sleeve 1, as illustrated in FIG. 10, it has a preferably encircling stop edge 9, which is in contact with the encircling edge of the packing sleeve 1.

The stop edge 9 need not be continuous. It can also be provided in the form of individual nubs or protuberances.

FIG. 4 also shows, in connection with FIG. 1, that the assembled lattice support 10 is placed in the direction indicated by the arrow 11 on the encircling upper edge of the packing sleeve 1.

As soon as the bars 16 illustrated in FIG. 7 have been completely packed, it is preferable if their top ends still project beyond the upper side of the packing sleeve 1. However, the invention is not limited to this configuration. They can also be flush with the lattice openings 14*a* in the top part.

The upper side of the packing sleeve 1 can be closed by any type of known protective sleeve 18 or by a flat cover 19, wherein the protective sleeve 18 or the cover 19 can be either snapped, screwed or pushed on or attached with a wedge-type connector. The closure between the parts 18 and 19 and the packing sleeve 1 can be any appropriate closure and can be accomplished in a manner which is in itself known. All that is necessary is that it be a re-openable packing.

During the placement of the top part 7 on the encircling opening 5 of the packing sleeve 1, it is preferable if the top part 7 is placed on the packing sleeve by means of a locking connection. For this purpose FIG. 10 shows that the top part 7 has a preferably encircling stacking edge 20 which is slightly beveled, so that a plurality of lattice supports 10 can be stacked one on top of another.

Starting from the stacking edge 20, there are locking lugs 25 directed radially outward that engage with the opening 5 of the packing sleeve 1 so that the top part 7 is reliably connected with the packing sleeve 1.

Instead of a snap-on connection of this type, other connecting mechanisms can also be provided, such as, for example, wedge-type connectors, an adhesive connection or a welded connection.

A comparison of FIGS. 9 and 10 shows that the lattice openings 14 of the top part 7 (lattice openings 14*a*) and the bottom part 8 (lattice openings 14*b*) are aligned with one another, and for this purpose webs are used that define the lattice openings. In the vicinity of the webs 22 there are radially inward-pointing nubs 23 that reduce the cross-section and preferably have insertion bevels, to thereby make possible a centered insertion and pushing through of the bars 16 to be packed.

To release the snap connection between the two parts 7 and 8, in the top part there are cutouts 21 opposite one another, in the vicinity of which the locking slots 15 are located, so that by means of manual force, the locking tabs 12 of the bottom part 8 that project into the slots 21 can be pressed together with finger pressure, to once again release the locked connection.

The flexible property of the locking tabs 12 is the result of the fact that there are slots 27 on both sides of the locking tabs, to provide them with radial flexibility.

Also in the vicinity of the external nubs 24 there are slots 27 on one side to also provide a flexible bias for the external nubs 24, to guarantee that the bottom part 8 is centered and simultaneously moves downward in the interior 2 of the packing sleeve 1 in the direction indicated by the arrow 17, without tipping or jamming.

Figure 16:
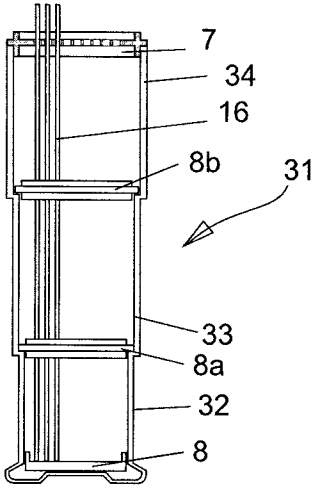
FIG. 16 illustrates an additional embodiment of a multi-level packing sleeve.

FIG. 16 shows a multi-part packing sleeve 31 that consists of a total of three steps 32-34, whereby each step differs from the others in its diameter.

The lattice support 10 used for this purpose is therefore designed and constructed of multiple parts and consists of a top part 7 and three bottom parts 8 that snap together, wherein the base-side bottom part 8 is the same as the bottom part described above and illustrated in FIGS. 9 and 10, although the other bottom parts 8*a*, 8*b* are intermediate parts and have the same lattice-like configurations illustrated in FIGS. 9 and 10, and overall the bottom part 8 consists of three parts that are detachably connected with the top part 7.

This arrangement illustrated in FIG. 16 has the advantage that with a multi-step packing sleeve 31, elongated bars 16 can also be centered in the interior without the need to use continuous insertion channels of the type known from the prior art.

Figure 17:
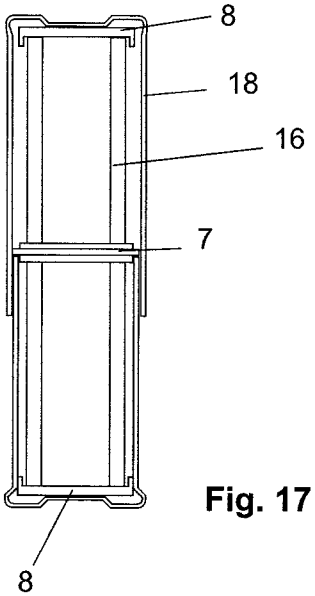
FIG. 17 illustrates a variant embodiment of a packing sleeve that differs from the one illustrated in FIGS. 1 and 16.

FIG. 17 shows, in the form of an additional exemplary embodiment, that the bars 16 can project by a significant portion of their length out of the top of the packing sleeve 1, and that for this purpose a protective sleeve 18 can be used, on the inside of which a bottom part 8 is attached which corresponds to the opposite bottom part 8. In this manner it is also possible to center and hold elongated bars 16 or other elongated objects in a relatively short packing sleeve 1.

Figure 18:
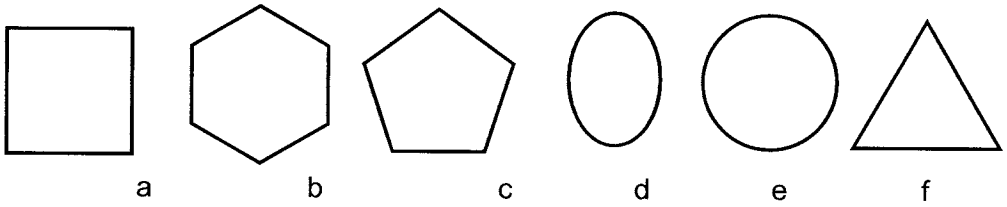
FIG. 18 shows the different profile shapes for packing sleeves according to the present invention.
Figure 11:
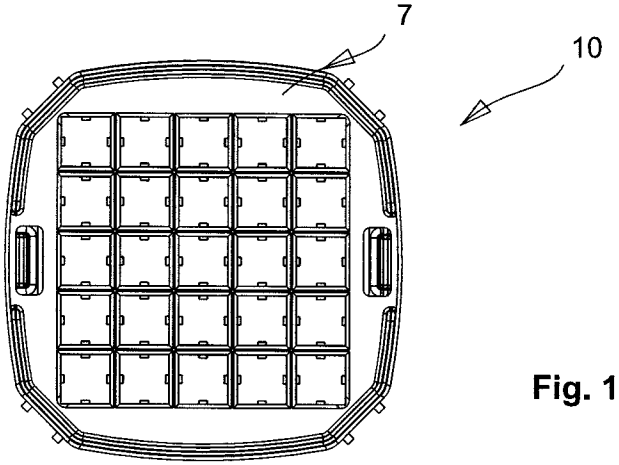
FIG. 11 illustrates a plan view from overhead of the top part of the lattice support corresponding to the illustration in FIG. 10.
Figure 12:
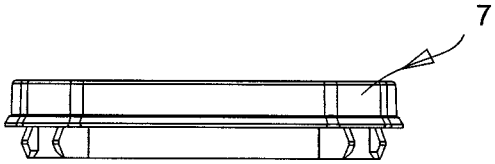
FIG. 12 illustrates a side view of the top part.
Figure 13:
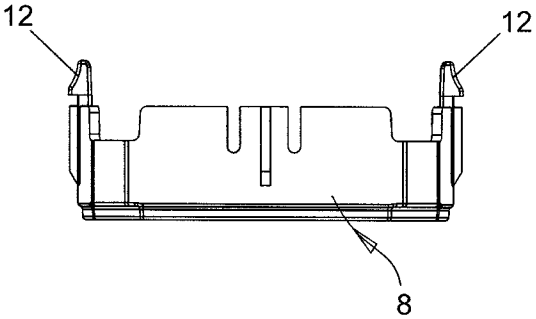
FIG. 13 illustrates a side view of the bottom part.
Figure 14:
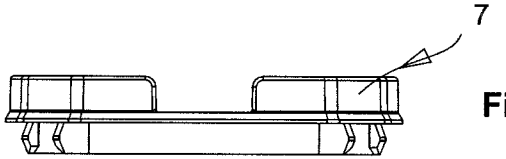
FIG. 14 illustrates the side view of the top part rotated by 90 degrees.
Figure 15:
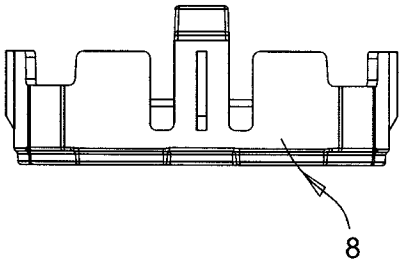
FIG. 15 illustrates the side view of the bottom part rotated by 90 degrees.

FIG. 18 illustrates different profile shapes of packing sleeves 1 of this type, so that it can be stated that the packing sleeve 1 can have any arbitrary profile shape as illustrated in FIG. 18, and the at least two-part lattice support 10 used according to the invention is suitable for each of the profile shapes illustrated in FIGS. 18*a*-18*f*.

LEGEND TO THE DRAWINGS

1 Packing sleeve
2 Interior
3 Base surface
4 Stabilizing foot
5 Opening
6 Side wall
7 Top part (of 10)
8 Bottom part (of 10)
9 Stop edge
10 Lattice support
11 Direction of arrow
12 Locking tabs
13 Direction of arrow
14 Lattice opening 14*a*, 14*b*
15 Locking opening
16 Bar
17 Direction of arrow
18 Protective sleeve
19 Cover
20 Stacking edge
21 Cutout
22 Web
23 Nub
24 Outer nub
25 Snap-on stud
26 Guide wall
27 Slot
28 Base wall
29 Direction of arrow

31 Packing sleeve
32 Step
33 Step
34 Step

What is claimed is:

1. A system for the spaced packing of elongated bar-shaped or rod-shaped objects, the system comprising:

an inner packing sleeve that is open on at least a top end;

a protective outer sleeve to provide closure for the top end of the inner packing sleeve, wherein the protective outer sleeve encloses at least a portion of the inner packing sleeve; and a multi-part lattice support consisting of at least one top part and at least one bottom part, wherein the multi-part lattice support is sized and configured to be positioned within the top end of the inner packing sleeve, and wherein the bottom part is detachably connected to the top part such that insertion of the bar-shaped or rod-shaped objects through aligned lattice openings of the top and bottom parts of the multi-part lattice support detaches the bottom part from the top part so that the bottom part can slide in an interior of the inner packing sleeve while the top part remains at the top end of the inner packing sleeve.

2. The system according to claim 1, wherein insertion of the bar-shaped or rod-shaped objects through the aligned lattice openings displaces the bottom part toward a base surface of the inner packing sleeve, wherein the base surface is opposite the top end of the inner packing sleeve.

3. The system according to claim 1, wherein the lattice openings of the bottom part of the multi-part lattice support comprise a grid pattern and dimensions configured so that each lattice opening encloses an end of the bar-shaped or rod-shaped objects.

4. The system according to claim 1, wherein the top part is placed in a locking manner on the bottom part such that manual force, machine force, or a combination thereof releases the detachable connection therebetween.

5. The system according to claim 1, wherein the detachable connection between the top and bottom parts comprises a snap connection that can be released by manual force, machine force, or a combination thereof.

6. The packing according to claim 1, wherein an outer periphery of the bottom part is sized to fit within an interior of the inner packing sleeve in a form-fitting manner.

7. The packing according to claim 1, wherein the top part has an increased diameter in the form of an at least partial radial stop edge that is in contact with an encircling edge of the top end of the inner packing sleeve.

8. The packing to claim 7, wherein the top part can be locked with the top end of the inner packing sleeve.

9. A method for packing elongated bar-shaped or rod-shaped objects in a packing sleeve, the method comprising:

placing a multi-part lattice support on an open end of a packing sleeve, wherein the multi-part lattice support comprises at least one top part detachably connected to at least one bottom part, wherein the top and bottom parts include an aligned lattice;

placing the elongated bar-shaped or rod-shaped objects on the multi-part lattice support with a lower end of the elongated bar-shaped or rod-shaped objects directed through lattice openings of the top part and into lattice openings of the bottom part so that the lower ends come to rest on a base wall which forms a bottom side of the bottom part, wherein the lattice openings of the bottom part comprise a grid pattern and dimensions configured so that each lattice opening encloses an end of the bar-shaped or rod-shaped objects, and releasing the detachable connection between the top part and the bottom part by manual pressure, mechanical force, or a combination thereof, wherein the elongated bar-shaped or rod-shaped objects and bottom part slide downward in the packing sleeve.

10. The method according to claim 9, wherein either as a result of the dead weight of the elongated bar-shaped or rod-shaped objects or by manual pressure on the elongated bar-shaped or rod-shaped objects, the bottom part is separated from the top part and is displaced into the interior of the packing sleeve until the bottom part sits on a base surface in the interior of the packing sleeve.

11. A system for the spaced packing of elongated bar-shaped or rod-shaped objects, the system comprising:

a packing sleeve that is open on a top end thereof; and a multi-part lattice support comprising a top part and a bottom part, wherein the bottom part is detachably connected to the top part, and wherein the multi-part lattice support is sized and configured to be positioned within the top end of the packing sleeve so that the top-part of the multi-part lattice support remains at the top end and the bottom-part is configured to be slidingly received by a bottom end of the packing sleeve when the bottom part is detached from the top part, and wherein the lattice openings of the bottom part of the multi-part lattice support comprise a lattice having a grid pattern and dimensions configured so that the lattice encloses an end of the bar-shaped or rod-shaped objects.

12. The system according to claim 11, wherein the top part and the bottom part of the multi-part lattice support each include a lattice having a grid pattern and dimensions, wherein the grid pattern and dimension of the lattices of the top part and the bottom part are configured to align with one another.

13. The system according to claim 11, wherein a detachable connection between the top part and the bottom-parts comprises a snap connection that can be released by manual force, machine force, or a combination thereof.

14. The system according to claim 11, wherein an outer periphery of the bottom part is sized to fit within an interior of the packing sleeve in a form-fitting manner.

15. The system according to claim 11, wherein the top part has an increased diameter in the form of an at least partial radial stop edge that is in contact with an edge of the top end of the packing sleeve.

16. The system according to claim 15, wherein the top part can be locked with the top end of the packing sleeve.

17. The system of claim 11, wherein the multi-part lattice support comprises two or more top parts and one bottom part, wherein the bottom part includes a base wall configured to support ends of the elongated bar-shaped or rod-shaped objects.

18. The system of claim 11, further comprising:

a protective outer sleeve or cover to provide closure for the top end of the packing sleeve, wherein the protective outer sleeve or cover is snapped, screwed, or pushed onto the packing sleeve.

19. The system of claim 1, wherein the multi-part lattice support comprises two or more top parts and one bottom part, wherein the bottom part includes a base wall configured to support ends of bar-shaped or rod-shaped objects.

20. The system of claim 11, further comprising:

a protective outer sleeve or cover to provide closure for the top end of the packing sleeve, wherein the protective outer sleeve or cover is snapped, screwed, or pushed onto the packing sleeve.

21. A system for the spaced packing of elongated bar-shaped or rod-shaped objects, the system comprising:

a packing sleeve open at a top end and closed on a bottom end; and a multi-part lattice support comprising a top part and a bottom part, wherein the top and bottom parts are plugged into each other and lockably connected by a detachable connection, wherein the detachable connection comprises a snap connection or a breakaway web, wherein the multi-part lattice support is sized and configured to be positioned within the top end of the packing sleeve so that the top part of the multi-part lattice support remains at the top end and the bottom part is slidingly received by a bottom end of the packing sleeve when the bottom part is detached from the top part, and wherein insertion of the elongated bar-shaped or rod-shaped objects through aligned lattice openings of the multi-part lattice support displaces the bottom part toward the bottom end of the packing sleeve.

* * * * *